United States Patent [19]

Iyama et al.

[11] 4,447,763

[45] May 8, 1984

[54] DISCHARGE LAMP LIGHTING DEVICE

[75] Inventors: Hiroyuki Iyama; Yoshio Watanabe, both of Tokyo, Japan

[73] Assignee: Hitachi Lighting, Ltd., Chiba, Japan

[21] Appl. No.: 368,163

[22] Filed: Apr. 14, 1982

[30] Foreign Application Priority Data

Apr. 15, 1981 [JP] Japan ..... 56-55581

[51] Int. Cl.[3] ..... H05B 41/16

[52] U.S. Cl. ..... 315/207; 315/101; 315/290; 315/DIG. 2

[58] Field of Search ..... 315/101, 105, 207, 289, 315/290, DIG. 2

[56] References Cited

U.S. PATENT DOCUMENTS

| | | | |
|---|---|---|---|
| 3,626,243 | 12/1971 | Koyama et al. | 315/207 X |
| 4,066,932 | 1/1978 | Rottier | 315/101 X |
| 4,210,850 | 7/1980 | Britton | 315/DIG. 2 |
| 4,306,177 | 12/1981 | Kaneda | 315/101 X |

FOREIGN PATENT DOCUMENTS

| | | | |
|---|---|---|---|
| 2413611 | 10/1974 | Fed. Rep. of Germany | 315/101 |
| 53-74772 | 7/1978 | Japan | 315/207 |

*Primary Examiner*—Eugene R. LaRoche

*Attorney, Agent, or Firm*—Antonelli, Terry & Wands

[57] ABSTRACT

A discharge lamp lighting device comprises a serial connection of an inductive ballast and a discharge lamp connected across an A.C. power source, and a switching circuit connected substantially in parallel to the discharge lamp and operable to carry out two consecutive ON/OFF operations in the beginning of each half cycle of the A.C. power source while the discharge lamp is in its lit condition. The switching circuit preferably comprises a full-wave rectifier connected substantially in parallel to the discharge lamp, a switching element connected between the output terminals of the rectifier, and a control circuit for controlling the ON/-OFF operation of the switching element.

10 Claims, 9 Drawing Figures

DISCHARGE LAMP LIGHTING DEVICE

BACKGROUND OF THE INVENTION

The present invention relates to a discharge lamp lighting device and, more particularly, to an improved discharge lamp lighting device with a switching circuit operating in every half cycle of an A.C. power voltage, wherein a choke coil is used as a ballast instead of a step-up transformer in the case where the power voltage is substantially equal to the operating voltage of the discharge lamp.

The conventional ballast for a discharge lamp is composed of, for example, an inductor or a transformer which is mainly made of copper and iron materials, resulting disadvantageously in a large power loss and also a bulky and heavy structure. In view of such situation, lighting devices which have a low power loss and which are small in size and light in weight due to the utilization of semiconductor circuitry have recently been commertialized. FIG. 1 shows a basic arrangement of a lighting circuit which drives a discharge lamp in every half cycle of the A.C. power voltage without use of a transformer even in the case where the operating voltage of the lamp approximates to the power voltage. In the figure, the circuit includes an A.C. current source 1 with a frequency of 50 Hz or 60 Hz, a choke coil 2 functioning as a ballast, a discharge lamp 3, a semiconductor switching circuit 4, which continues its operation also during the lit condition of the lamp 3, and a noise suppressing capacitor 5. In operating the lighting circuit, the switching circuit 4 is closed at the beginning of each half cycle of the power voltage so that a short-circuit current flows through the choke coil 2 whereby to charge electromagnetic energy in it. The switching circuit 4 is cut off when the short-circuit current has reached a predetermined value, i.e. the cut-off current $I_{cut}$. The cut-off of the circuit 4 causes the choke coil 2 to generate a high pulse voltage which reignites the lamp 3 in each half cycle of the power voltage. Thereafter, the electromagnetic energy stored in the choke coil 2 is applied to the lamp 3 in addition to the voltage of the source 1 so that the discharge of the lamp may last until the end of the half cycle. Upon the completion of the half cycle, the switching circuit 4 is closed again and the above-mentioned operation is repeated in every following half cycle so that the lamp 3 is maintained in its lit state. The foregoing operation allows the stable lit condition of the lamp without using any transformer even in the case where the operating voltage of the lamp 3 is substantially equal to the voltage of the power source 1.

There have been proposed two circuit systems for the switching circuit 4 in the lighting circuit of this type, one being such a circuit system which performs an ON/OFF operation only once at the beginning of each half cycle, as disclosed in U.S. Pat. No. 3,997,814 entitled "Discharge Lamp Lighting Device", and the other being such a circuit system which performs a repetitive relaxation oscillation between the capacitor 5 and the switching circuit 4 so as to establish an equivalent ON-state, as disclosed in U.S. Pat. No. 4,079,292 entitled "Arc Discharge Sustaining Circuit System for a Discharge Lamp". There are problems, however, in these circuit systems. First, the former circuit system has such disadvantages as will be described hereunder. (1) In the case of a 40-watt energy-saving fluorescent lamp which requires a high pulse voltage for starting thereof, a high starting voltage of approximately 1000–1200 volts is required at a low ambient temperature. Therefore, a switching element having a high blocking voltage is needed as a component of the switching circuit 4. (2) In the case where a large noise suppression capacitor 5 can be used, the capacitor 5 is charged to in excess of one thousand volts by a pulse voltage caused by the cut-off operation of the switching circuit 4 and this electric charge produces a pulse current through the lamp 3 after the latter has been reignited. The peak value of this current may extend to ten times the effective current of the lamp 3, resulting in a short operating life due to the blackening of the lamp wall. On the other hand, if the capacitor 5 is eliminated, a larger cut-off current $I_{cut}$ is required. In order to achieve this operation, therefore, a switching element having a high blocking voltage and a small power loss is necessary as a component of the switching circuit 4. However, there is no proper switching element presently available for this purpose.

Next, the disadvantages of the latter circuit system are as follows: Since the switching circuit 4 repeats its on and off operations while it has to maintain its ON-state, the virtual period of its ON-state is shortened, resulting in an increased period wherein no lamp current flows. This remarkably deteriorates the efficiency of the lamp, particularly of the fluorescent lamp. In addition, the voltage oscillation by reignition causes high level radio frequency noises.

SUMMARY OF THE INVENTION

Accordingly, it is an object of the present invention to provide a discharge lamp lighting device of the type of driving the lamp in every half cycle of the A.C. power voltage, wherein the lamp can be started and maintained in its lit state with a lower pulse voltage and a smaller cut-off current.

In order to achieve the above-mentioned object, the discharge lamp lighting device according to the present invention comprises a series circuit composed of a discharge lamp and an inductive ballast and connected across an A.C. power source, and a switching circuit connected substantially in parallel to the discharge lamp and arranged to repeat its ON/OFF operations only twice in the beginning of each half cycle of the A.C. power voltage while the discharge lamp is in its lit condition. The switching circuit preferably comprises a full-wave rectifier connected substantially in parallel to the discharge lamp, a switching element connected between the output terminals of the rectifier, and a control circuit connected to the switching element so as to control the ON/OFF operation of the switching element. The switching circuit generally operates in the following manner. The control circuit detects the end of discharge in the beginning of each half cycle of the A.C. power voltage to make the switching element conductive, and makes the switching element nonconductive when the magnitude of the current in the switching element reaches a first predetermined value. As a result, a first pulse voltage is generated. The control circuit makes the switching element conductive again in response to the first pulse voltage, and makes it nonconductive when the magnitude of the current reaches a second predetermined value. Then the second pulse voltage is generated. After this the control circuit does not make the switching element conductive in response to the second pulse voltage, but instead holds the switching element nonconductive until the end of the half cycle.

The lighting circuit according to the present invention causes the switching circuit 4 to effect its ON/OFF operations consecutively only twice at the beginning of each half cycle of the A.C. power voltage while the lamp is lit, allowing the smaller amplitude of the cut-off current necessary for the normal lit condition as compared with the case of the single ON/OFF operation. Furthermore, in starting the lamp, the current cut-off operation for generating the starting pulse voltage takes place twice or more in every half cycle, allowing a considerable reduction in the amplitude of the starting voltage as compared with the case of the single pulse operation. Moreover, in the case where the conventional lighting circuit is used for lighting a high intensity discharge lamp such as a metal halide lamp or a high pressure mercury lamp, since the lamp current equals zero in the ON period of the switching circuit 4 so that the arc in the lamp may be cooled in this period, the required reignition voltage tends to abnormally increase resulting in failure of lighting. According to the present invention, however, the lighting circuit applies another additional pulse voltage to the lamp while the switching circuit 4 is turned on to charge the choke coil 2 so as to recover ion pairs which have been once decreased. Consequently, the high intensity discharge lamp can be lit uninterruptedly.

DESCRIPTION OF THE PREFERRED EMBODIMENTS

Figure 1:
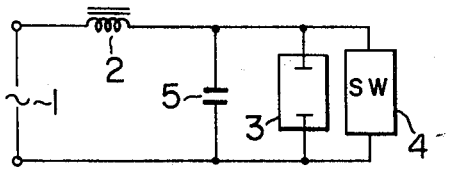
FIG. 1 PRIOR ART
FIG. 1 is a schematic diagram illustrating the basic arrangement of a discharge lamp lighting device of the type for driving the lamp in every half cycle of the A.C. power voltage.
Figure 2:
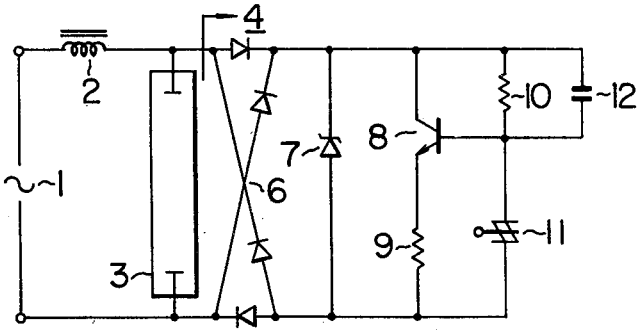
FIG. 2 is a schematic diagram of the discharge lamp lighting device according to the present invention.

FIG. 2 shows a circuit arrangement of a discharge lamp lighting device according to an embodiment of the present invention. A switching circuit 4 includes a full-wave rectifier 6 for the convenience of using a transistor 8 as a main switching element. The switching circuit 4 further includes an avalanche diode 7 for protecting the transistor 8 from break-down, resistors 9 and 10, and a voltage sensing switch 11 such as a silicon bilateral switch (SBS).

Figure 3:
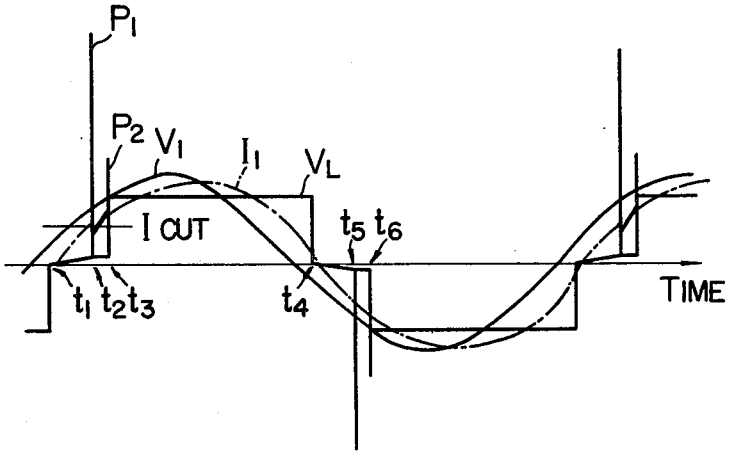
FIG. 3 is a waveform diagram for explaining the operation of the circuit shown in FIG. 2.

The operation of the device in the lit state of the lamp 3 will be described with reference to the voltage and current waveforms shown in FIG. 3. When the discharge in the preceding half cycle has completed at time $t_1$, the voltage $V_L$ across the lamp 3 makes a transition in its polarity passing through zero point, thereby turning the voltage sensing switch 11 off. This allows the transistor 8 to be supplied with a base current, so that the switching circuit 4 ensures its ON state (from t1 to t2). When the current $I_1$ flowing through the choke coil 2 reaches a predetermined value $I_{cut}$, the voltage drop across the resistor 9 brings the voltage across the voltage sensing switch 11 to its breakover point so as to turn the voltage sensing switch 11 on. Then the base current of the transistor 8 is cut off, thereby turning switching circuit 4 off (at t2). This current cut-off operation causes the choke coil 2 to generate a high voltage pulse $P_1$ across the coil. The pulse voltage $P_1$ is applied to the lamp 3 to reignite the latter and also charges the capacitor 12. Subsequently, since the falling rate of the pulse voltage $P_1$ is larger than the discharging rate of the capacitor 12, the current in the voltage sensing switch 11 falls to zero or below the holding current so as to turn the voltage sensing switch 11 off. Then the base current is supplied to the transistor 8 to turn it on so that the switching circuit 4 assumes its ON state again. Thus, the current $I_1$ begins to flow again. However, the initial value of the current $I_1$ is smaller than the cut-off current $I_{cut}$ at t2 because the pulse voltage $P_1$ is partly lost in the lamp 3 and the capacitor 12. When the current reaches the value $I_{cut}$ again at t3, the voltage sensing switch 11 is turned on so as to make the transistor 8 nonconductive, thereby turning the switching circuit 4 off. This operation generates a pulse voltage $P_2$. However, the lamp 3 has been reignited by the preceding pulse voltage $P_1$, and the pulse voltage $P_2$ is mostly lost in the lamp 3, resulting in a significant reduction in the amplitude of the pulse voltage $P_2$ with respect to the pulse voltage $P_1$. Accordingly, the capacitor 12 is less charged and the current in the voltage sensing switch 11 does not fall below the holding current during the fall of the pulse voltage $P_2$. Thus the switching circuit 4 maintains the OFF state and the electromagnetic energy stored in the choke coil 2 is applied to the lamp 3 in addition to the voltage $V_1$ of the power source 1 so as to effect the discharge in the remaining portion of the half cycle (from t3 to t4).

When the discharge in this preceding half cycle has completed at t4, the lamp voltage $V_L$ reverses the polarity. However, the switching circuit 4 receives the power voltage through the full-wave rectifier 6, and thus the operating state recurs to the initial state (at t1). Thus the discharge lamp 3 is continuously maintained in its normal lit state by repeating the foregoing operations.

It should be noted that the switching circuit 4 provides the same cut-off current $I_{cut}$ at t2 and t3, whereas the input current exceeds the $I_{cut}$ at t3. This results from the fact that a current may flow into the lamp 3 in the period from t2 to t3, since the lamp has been reignited by the pulse voltage $P_1$. This situation is equivalent to the assumption that the cut-off current at t3 is larger than the cut-off current $I_{cut}$ at t2. Cut-off operations for more than twice will result in a far less increase in the $I_{cut}$ as compared with the case of the dual cut-off operation and, moreover, additional ON states of the switching circuit 4 prolongs the discharge halt period for the lamp 3, resulting in a decreased lamp efficiency. Thus the dual cut-off operation provides the best effectiveness.

Figure 4:
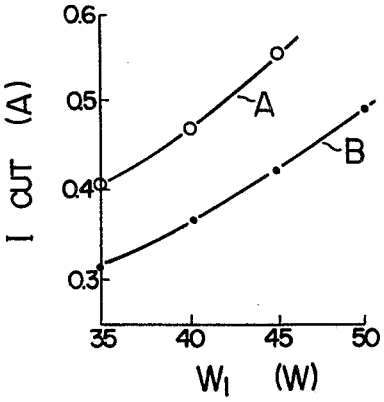
FIGS. 4 and 5 are graphical representations showing the characteristics of the discharge lamp lighting device according to the present invention, FIG. 4 showing the relationship between the input power W1 and the cut-off current $I_{cut}$, while FIG. 5 showing the relationship between the pulse voltage and the probability of starting.

FIG. 4 is a graphical representation evaluating the necessary cut-off current $I_{cut}$ against the input wattage $W_1$ for a 40-watt fluorescent lamp driven through a 110 Ω choke coil 2. Curve A represents the cut-off current for the conventional single cut-off operation and curve B represents the cut-off current for the dual cut-off operation according to an embodiment of the present invention as shown in FIG. 2. It can be seen from FIG. 4 that the dual cut-off operation achieves a reduction of the cut-off current $I_{cut}$ by approximately 20% from the case of the conventional single cut-off operation. This allows the transistor 8 to be reduced in its current capacity, and makes smaller the power loss caused by the transistor 8, the driving resistor 10, emitter resistance 9, etc. On the other hand, the lamp 3 needs a voltage of around 1000 volts for starting, and there is not available presently such a high breakdown voltage transistor or other switching element having a large D.C. current transfer ratio $h_{FE}$ and making smaller the power loss in the resistor 10.

Figure 5:
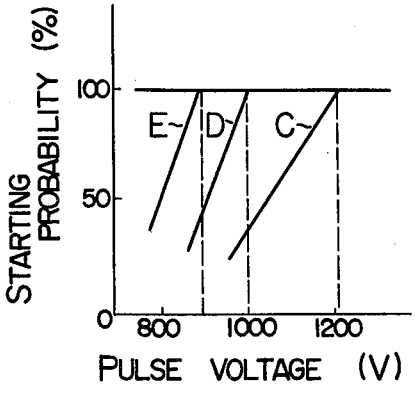

FIG. 5 shows the relationship between the applied pulse voltage for starting a 40-watt fluorescent lamp and the probability of starting the lamp in the ambient temperature of −10° C. In the graph, line C is the case of the conventional single cut-off operation, indicating that a pulse voltage of 1200 volts is required to obtain the starting probability of 100%. Line D shows the case of the present invention wherein the dual cut-off operation is carried out during each half cycle, indicating that the lamp is surely started by 1000 volts allowing a reduction of 200 volts relative to the conventional circuit.

In the circuit arrangement of FIG. 2, the amplitude of the pulse voltage determines whether or not the successive cut-off (ON/OFF) operation should take place. If the lamp 3 does not break over, the pulse voltage caused by the second cut-off operation has substantially the same amplitude as that of the first one, and thus the third (and could be the fourth) cut-off operation will proceed for generating another pulse voltage. The starting operation with more than two cut-off operations provides substantially the same starting probability as for the dual cut-off operation shown by line D in FIG. 5. Line E in FIG. 5 represents the starting probability for the dual cut-off operation with a capacitor of 1000 pF, which does not adversely affect the blackening on the lamp wall, is connected across the lamp 3, indicating a further reduction of the pulse voltage by 100 volts relative to the case of line D. The starting voltage for the conventional single cut-off operation shown by line C can also be lowered by connecting such a capacitor across the lamp 3. However, a relatively large capacitance value is required for the capacitor in this case, that adversely affects the life of the lamp 3 due to the blackening.

As described above, the dual cut-off operation according to the present invention may reduce the cut-off current as well as, the pulse voltage, allowing significant reduction in the power capacity of the transistor 8 (or other switching element).

Figure 6:
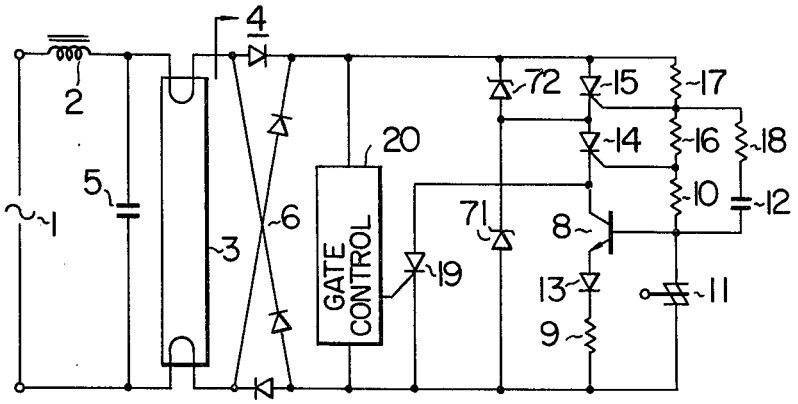
FIGS. 6, 7, 8 and 9 are schematic diagrams showing other embodiments of the present invention.

FIG. 6 shows another embodiment of the discharge lamp lighting device according to the present invention. This embodiment contemplates to eliminate the disadvantage of FIG. 2 circuit in that such a transistor 8 having a high blocking voltage of 1000 volts or higher and a high D.C. current transfer ratio $h_{FE}$ is not available. In this FIG. 6 embodiment, a transistor 8 having a low blocking-voltage and a high D.C. current transfer ratio $h_{FE}$ is used and a series circuit of thyristors (SCRs) 14 and 15 is connected in series with the transistor 8 so as to provide a high blocking voltage. Since a preheat-start fluorescent lamp is used as a discharge lamp 3 in this embodiment, the arrangement further includes a thyristor 19 for feeding a preheat current to the lamp 3 in starting and a gate control circuit 20 for the thyristor. Reference numeral 5 denotes a capacitor having a small capacitance which does not adversely affect the blackening of the lamp 3. A series circuit of a capacitor 12 for the dual pulse generation and a resistor 18 to ensure the stable operation is connected between the gate of the thyristor 15 and the base of the transistor 8.

The operation of this embodiment will be described briefly referring to the voltage and current waveforms shown in FIG. 3. At time t1 when the discharge in the preceding half cycle has completed, the voltage sensing switch 11 is turned off. Then the transistor 8 and thyristors 14 and 15 are sequentially triggered by the arrangement of trigger circuit resistors 17, 16 and 10, and the switching circuit 4 is turned on. When the voltage sensing switch 11 is turned on at t2, the transistor 8 is turned off. Then the capacitor 5 is charged with a slope determined by a charging speed through the choke coil 2. At the same time, the reverse current from the gate of the thyristor 14 flows through the resistor 10 and voltage sensing switch 11, and the reverse current from the gate of the thyristor 15 flows through the resistor 18, the capacitor 12 and the voltage sensing switch 11. The thyristor 14 is turned off before the voltage applied to the transistor 8 reaches the breakdown voltage, and therefore the thyristor 15 is also turned off (at t2). In this case if the resistors 10 and 18 have similar values, the thyristors 15 and 14 may turn off in different order depending on their characteristics. This cut-off operation generates a pulse voltage $P_1$ which in turn charges the capacitor 12 through the resistor 18 and the voltage sensing switch 11. The pulse voltage $P_1$ applied across the lamp 3 falls faster than the discharging of the capacitor 12 and, consequently, the current flowing though the voltage sensing switch 11 decreases below the holding current so as to turn the switch 14 off. Then the switching circuit 4 is turned on again, and thereafter turned off again at t3. The pulse voltage $P_2$ generated at this time does not have a large amplitude enough to turn the voltage sensing switch 11 off. Thus the third pulse generating operation does not take place and the lamp 3 continues discharging for the remaining portion of the half cycle. In this circuit arrangement, the value of the resistor 10 can be made small and, therefore, the transistor 8 causes a little loss even if it has a small D.C. current transfer ratio $h_{FE}$ of around 100. Furthermore, if the thyristors 14 and 15 have a blocking voltage of 600 volts, it is possible to generate a pulse voltage of 1200 volts. It will be understood that the amplitude of the pulse voltage is determined by the sum of the breakdown voltages of the avalanche diodes 71 and 72.

The amplitude of the second pulse voltage $P_2$ tends to increase as the ambient temperature falls in the case of the fluorescent lamp. However, the pulse voltage $P_2$ can be maintained without changing from the value in the case of normal ambient temperature so as to assure the stable dual cut-off operation in the virtue of connection of the capacitor 5 having a small capacitance, e.g. 2000 pF, which does not adversely affect the life of the lamp 3 due to the blackening. In the foregoing arrangement, the cut-off current $I_{cut}$ is identical for the first and second cut-off operations. However, the second cut-off operation may provide a larger cut-off current $I_{cut}$ than that for the first one by providing for example, a larger capacitor connected in parallel to the resistor 9, or conversely, the first cut-off operation may provide a larger $I_{cut}$ than that of the second one, similarly.

In the case where a high intensity discharge lamp such as a metal halide lamp is used as the lamp 3, the second cut-off operation provides less increase in the effective cut-off current. In this case, the arc in the lamp can be prevented from cooling by making the cut-off current $I_{cut}$ at t2 smaller than that at t3 and by applying the pulse voltage $P_1$ at t2, thereby preventing effectively the extinguishment of the arc due to the ON period of the switching circuit 4. It will further be appreciated that the multiple pulse voltages are effective in starting the lamp 3.

Figure 7:
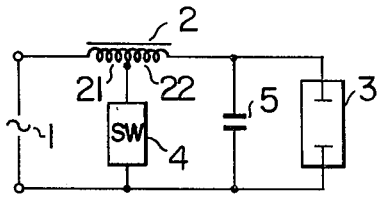

FIG. 7 shows still another embodiment of the discharge lamp lighting device according to the present invention. The circuit arrangement includes a choke coil 2 having an intermediate tap connected to a switching circuit 4 which may be the same as that shown in FIG. 2 or FIG. 6. It will be appreciated that the resistor 18 in FIG. 6 may be connected to the gate of the thyristor 14 or to the anode of the thyristor 15, instead of being connected to the gate of the thyristor 15.

Figure 8:
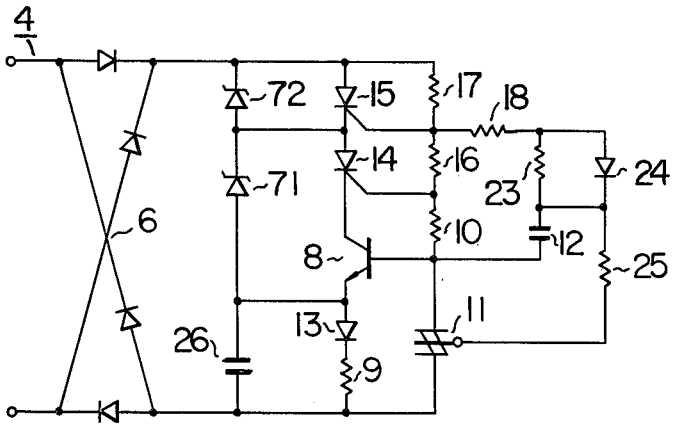

FIG. 8 shows an embodiment of the discharge lamp lighting device according to the present invention, wherein the foregoing dual cut-off operation is further stabilized. This is achieved in this circuit arrangement by utilizing the fact that a capacitor 12 is charged to different voltages by the first pulse voltage and by the second pulse voltage. A resistor 23 is used to optimize the discharging time-constant of the capacitor 12. A diode 24 serves as a bypass diode for preventing a sharp rise of the D.C. output voltage of a rectifier 6 caused by the voltage drop across the resistor 23 by the charging current to the capacitor 12 during the cut-off operation. The charging voltage of the capacitor 12 is adjusted by appropriately chosing the values of the diode 24, resistor 18 and capacitor 12. A resistor 25 provides a reverse bias to the gate of a voltage sensing switch 11 such as an SBS. A capacitor 26 ensures the reverse bias between the base and emitter of a transistor 8 after the voltage sensing switch 11 has been turned on.

In operation, when the capacitor 12 has been charged to a high voltage by a first pulse voltage, the voltage sensing switch 11 is reverse-biased through the resistor 25, resulting in a large holding current. Therefore, the current flowing from the anode to the cathode of the voltage sensing switch 11 decreases as the amplitude of the pulse voltage decreases, and falls easily below the holding current so that the voltage sensing switch 11 is turned off. Then the subsequent current cut-off operation takes place to generate a second pulse voltage. This pulse voltage is small in amplitude and narrow in width, resulting in a low voltage which charges the capacitor 12. Accordingly, the gate of the voltage sensing switch 11 is reverse-biased in less degree relative to the case of the first pulse voltage, and the holding current does not substantially increase. Consequently, the current flowing through the voltage sensing switch 11 does not fall below the holding current when the amplitude of the second pulse voltage decreases, and the voltage sensing switch 11 maintains its ON state. It will be understood from the above description that this embodiment ensure the dual cut-off operation in each half cycle while the lamp 3 is in its normal lit condition.

Figure 9:
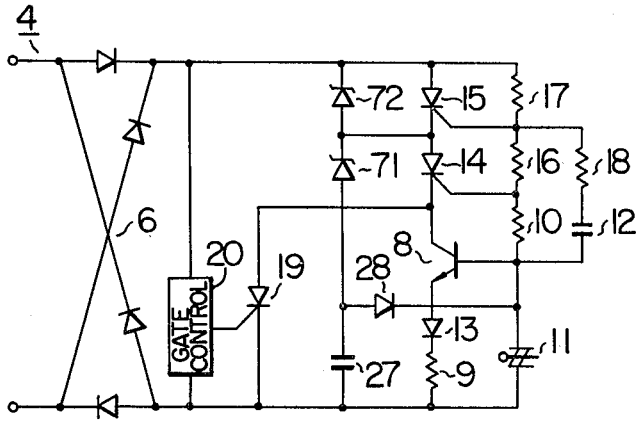

FIG. 9 shows still another embodiment of the discharge lamp lighting device according to the present invention. In the foregoing circuit arrangements for the dual cut-off operation during the lit condition utilizes the fact that the amplitude of a second pulse voltage varies significantly from that of a first pulse voltage. Therefore, if the lamp 3 fails to light up due to, for example, the end of the service life, numerous pulse voltages will be generated in each cycle. The energy of these pulse voltages is not absorbed by the lamp 3, causing possibly the destruction of protective avalanche diodes 71 and 72 due to over power dissipation. This situation can be prevented by the circuit arrangement which performs the multi-pulse generation only during the starting period of the lamp and restores the single pulse generation if the lamp 3 does not light within that period. In order to practice the operation, the circuit of this embodiment is arranged such that the current flowing through the avalanche diode 71 is charged in a capacitor 27 and, then, discharged through a diode 28 and a voltage sensing switch 11. In operation, a gate control circuit 20 first triggers a thyristor 19 so as to preheat the electrodes of the lamp 3. During the preheating period, the amplitude of each pulse voltage is too small to provide a current through the protective avalanche diode 71 and, therefore, the capacitor 27 is not charged. After the preheating has completed and a thyristor 19 is not longer turned on, a pulse voltage is generated in an open-circuit state and therefore the amplitude thereof is large enough to charge the capacitor 27. In this case, plural pulse voltages are successively generated during a half cycle until the lamp 3 falls into the breakover. Consequently, the avalanche current is allowed to flow through the protective avalanche diode 71, and when the voltage of the capacitor 27 has reached the value to make the diode 28 and the voltage sensing switch 11 conductive, the capacitor 27 starts to discharge through the voltage sensing switch 11. Accordingly, if the lamp 3 does not light up in the subsequent half cycle or within the following few half cycles, the avalanche current of the protective avalanche diode 71 caused by the first pulse voltage will flow through the voltage sensing switch 11. Even after the pulse voltage has fallen, the voltage sensing switch 11 does not become conductive due to a large number of minority carriers in its gate area. Thus, in the case where pulse voltages are successively generated in the open-circuit state, the single cut-off operation takes place after the following one to few half cycles, so that the protective avalanche diodes 72 and 71 can be protected from destruction. This arrangement can be applied to the circuit shown in FIG. 8, and the same effect will result.

This embodiment can also be applied to the case where a high intensity discharge lamp which does not need preheating is used as the lamp 3. This circuit arrangement allows the circuit of the single cut-off operation during the lit condition to generate multiple pulse voltages only in the lamp starting period by setting a large holding current for the voltage sensing switch 11, and also allows the circuit to carry out the single cut-off operation if the lamp has failed to light up.

As described above, the present invention realizes a discharge lamp lighting device of the type of driving the lamp in every half cycle of the power voltage which starts and maintains the lit condition of the discharge lamp using a lower pulse voltage and smaller cut-off current relative to prior art devices. In consequence, the switching circuit can be made with less expensive circuit components, thereby providing a low cost discharge lamp lighting device.

What is claimed is:

1. A discharge lamp lighting device comprising a serial circuit of an inductive ballast and a discharge lamp connected across an A.C. power source, and a switching circuit connected substantially in parallel to said discharge lamp, said switching circuit carrying out only two consecutive ON/OFF operations in the beginning of each half cycle of said A.C. power source during the lit condition of said discharge lamp.

2. A discharge lamp lighting device according to claim 1, wherein said switching circuit comprises a full-wave rectifier connected substantially in parallel to said discharge lamp, a controlled switching element connected across the output of said rectifier, and a control circuit connected to said switching element for controlling the ON/OFF operation of said switching element.

3. A discharge lamp lighting device according to claim 2, wherein said control circuit comprises a voltage sensitive switching element connected to said controlled switching element and a capacitor connected to said rectifier and said controlled switching element so that said voltage sensitive switching element and said capacitor allows, in cooperation with each other, said controlled switching element to carry out said two consecutive ON/OFF operations.

4. A discharge lamp lighting device according to claim 2, wherein said controlled switching element comprises a switching transistor.

5. A discharge lamp lighting device comprising a serial circuit of an inductive ballast and a discharge lamp connected across an A.C. power source, and a switching circuit connected substantially in parallel to said discharge lamp, and further comprising control means to first operate said switching circuit during the lit condition of said discharging lamp to operate so that said switching circuit is made conductive upon the detection of the end of discharge of said discharge lamp in the beginning of each half cycle of the A.C. power voltage and is made nonconductive when the amplitude of the current flowing in said switching circuit has reached a first predetermined value so that a first pulse voltage is produced, and to substantially operate said switching circuit to be made conductive again in response to said first pulse voltage and then made nonconductive again when the amplitude of the current flowing in said switching circuit has reached a second predetermined value so that a second pulse voltage is produced, wherein said control means further includes means for preventing said switching circuit from beginning conductive in response to said second pulse voltage so that said switching circuit maintains its nonconductive state until said half cycle is terminated.

6. A discharge lamp lighting device comprising a serial circuit of an inductive ballast and a discharge lamp connected across an A.C. power source, and a switching circuit connected substantially in parallel to said discharge lamp, said switching circuit carrying out only two consecutive ON/OFF operations in the beginning of each half cycle of said A.C. power source, wherein the first ON/OFF operation of said switching means produces a first pulse voltage through said discharge lamp to reignite said discharge lamp during each half cycle and said second ON/OFF operation of said switching means produces a second voltage pulse operating in conjunction with the first pulse voltage to maintain the discharge lamp in its lit condition during each said half cycle.

7. A discharge lamp lighting device according to claim 6, wherein said switching circuit comprises a full-wave rectifier connected substantially in parallel to said discharge lamp, a controlled switching element connected across the output of said rectifier, and a control circuit connected to said switching element for controlling the ON/OFF operation of said switching element.

8. A discharge lamp lighting device according to claim 7, wherein said control circuit comprises a voltage sensitive switching element connected to said controlled switching element and a capacitor connected to said rectifier and said controlled switching element so that said voltage sensitive switching element and said capacitor allows, in cooperation with each other, said controlled switching element to carry out said two consecutive ON/OFF operations.

9. A discharge lamp lighting device according to claim 7, wherein said controlled switching element comprises a switching transistor.

10. A discharge lamp lighting device comprising a serial circuit of an inductive ballast and a discharge lamp connected across an A.C. power source, and a switching circuit connected substantially in parallel to said discharge lamp, and further comprising control means to first operate said switching circuit so that said switching circuit is made conductive upon the detection of the end of discharge of said discharge lamp in the beginning of each half cycle of the A.C. power voltage and is made nonconductive when the amplitude of the current flowing in said switching circuit has reached a first predetemined value so that a first pulse voltage is produced to reignite said discharge lamp and to substantially operate said switching circuit to be made conductive again in response to said first pulse voltage and then made nonconductive again when the amplitude of the current flowing in said switching circuit has reached a second predetermined value so that a second pulse voltage is produced which, in conjunction with the first pulse voltage, maintains said discharge lamp in a lit condition during each said half cycle, wherein said control means further includes means for preventing said switching circuit from becoming conductive in response to said second pulse voltage so that said switching circuit maintains its nonconductive state until said half cycle is terminated.

* * * * *